US006879091B2

(12) United States Patent
Venugopal et al.

(10) Patent No.: US 6,879,091 B2
(45) Date of Patent: Apr. 12, 2005

(54) COMPOSITE ELECTRODE MATERIALS FOR ELECTRIC LAMPS AND METHODS OF MANUFACTURE THEREOF

(75) Inventors: Shankar Madras Venugopal, Karnataka (IN); Alok M. Srivastava, Niskayuna, NY (US); Holly Ann Comanzo, Niskayuna, NY (US); Vikas Midha, Clifton Park, NY (US); William Winder Beers, Chesterland, OH (US); Gopi Chandran Ramachandran, Karnataka (IN); Mukunda Srinivas Adyam, Karnataka (IN)

(73) Assignee: General Electric Company, Niskayuna, NY (US)

( * ) Notice: Subject to any disclaimer, the term of this patent is extended or adjusted under 35 U.S.C. 154(b) by 11 days.

(21) Appl. No.: 10/452,017

(22) Filed: May 30, 2003

(65) Prior Publication Data

US 2004/0239225 A1 Dec. 2, 2004

(51) Int. Cl.[7] ..... H01J 1/38

(52) U.S. Cl. ..... 313/311; 313/491; 313/630; 313/633

(58) Field of Search ..... 313/310, 311, 313/346 R, 352, 491, 630, 633

(56) References Cited

U.S. PATENT DOCUMENTS 5,744,905 A * 4/1998 Mehrotra et al. ..... 313/491
6,384,534 B1 * 5/2002 Srivastava et al. ..... 313/633

* cited by examiner

*Primary Examiner*—Vip Patel
*Assistant Examiner*—Glenn D. Zimmerman
(74) *Attorney, Agent, or Firm*—Fletcher Yoder

(57) ABSTRACT

An electron emissive composition comprises a barium tantalate composition in an amount of about 50 to about 95 wt %; and a ferroelectric oxide composition in an amount of about 5 to about 50 wt %, wherein the weight percents are based on the total weight of the barium tantalate composition and the ferroelectric oxide composition. A method for manufacturing an electron emissive composition comprises blending a barium tantalate composition in an amount of about 50 to about 95 wt % with a ferroelectric oxide composition in an amount of about 5 to about 50 wt % to form an electron emissive precursor composition, wherein the weight percents are based on the total weight of the barium tantalate composition and the ferroelectric oxide composition; and sintering the composition at a temperature of about 1000° C. to about 1700° C.

19 Claims, 4 Drawing Sheets

COMPOSITE ELECTRODE MATERIALS FOR ELECTRIC LAMPS AND METHODS OF MANUFACTURE THEREOF

BACKGROUND

This disclosure relates to composite electrode materials for electric lamps and methods of manufacture thereof.

The standard electron emissive coating currently used in a majority of electrodes of commercial fluorescent lamps contains a mixture of barium, calcium, and strontium oxides ("triple oxide emissive mixture"). Since these oxides are highly sensitive to ambient carbon dioxide and water, they are generally placed on the lamp electrodes initially as a wet mixture suspension of barium, calcium and strontium carbonates containing a binder and a solvent. The wet mixture suspension is then "activated" inside the lamp assembly during the manufacturing process by resistively heating the electrodes until the carbonates decompose, releasing carbon dioxide and some carbon monoxide, and leaving behind a triple oxide emissive mixture on the electrode.

However, the triple oxide emissive mixture suffers from several drawbacks. First, the "activation" requires an undesirably high temperature to convert the carbonates to oxides. The conversion of the carbonates to oxides undesirably releases carbon dioxide and some carbon monoxide. Incomplete activation can also lead to lamp performance issues like high ignition voltage, premature cathode breakdown, and loss in light output due to early wall darkening. Additionally, lamps having electrodes coated with the triple oxide emissive mixture have a rather short operating lifetime. Triple oxide emissive mixtures have therefore been substituted with barium tantalate emissive mixtures having various barium to tantalum ratios. The activation of barium tantalate is simple, as it does not require the decomposition of carbonates. "Activation" in this case is needed only to burn out the binder and remove the water vapor. Moreover, barium tantalate permits a higher loading of the cathode than the triple-oxide emissive mixture. The barium tantalate emissive mixtures are generally "activated" in less time and at a lower temperature than the triple oxide emissive mixture. Furthermore, lamps having electrodes coated with the barium tantalate emissive mixtures have a longer operating lifetime than the lamps with the triple oxide emissive mixture. However, a fluorescent lamp containing the barium tantalate emissive mixture generally has a somewhat inferior efficacy compared to the triple oxide emissive mixture. Adsorbed moisture is believed to be one of the reasons leading to dark band formation during the first one hundred hours of lamp operation. In addition, the moisture sensitivity of the barium tantalate emissive mixture gives rise to many serious manufacturing and processing issues. It is therefore generally desirable to develop a composition for discharge lamps which can function efficiently and which can reduce or even eliminate some of the moisture sensitivity issues presented by the barium tantalate emissive mixture.

SUMMARY

In one embodiment, an electron emissive composition comprises a barium tantalate composition in an amount of about 50 to about 95 wt %; and a ferroelectric oxide composition in an amount of about 5 to about 50 wt %, wherein the weight percents are based on the total weight of the barium tantalate composition and the ferroelectric oxide composition.

In another embodiment, a method for manufacturing an electron emissive composition comprises blending a barium tantalate composition in an amount of about 50 to about 95 wt % with a ferroelectric oxide composition in an amount of about 5 to about 50 wt % to form an electron emissive precursor composition, wherein the weight percents are based on the total weight of the barium tantalate composition and the ferroelectric oxide composition; and sintering the composition at a temperature of about 1000° C. to about 1700° C.

In yet another embodiment, an electrode comprises a substrate and an electron emissive composition disposed upon the substrate, wherein the electron emissive composition comprises a barium tantalate composition in an amount of about 50 to about 95 wt % and a ferroelectric oxide composition in an amount of about 5 to about 50 wt %, wherein the weight percents are based on the total weight of the barium tantalate composition and the ferroelectric composition.

DETAILED DESCRIPTION OF PREFERRED EMBODIMENTS

Figure 1:
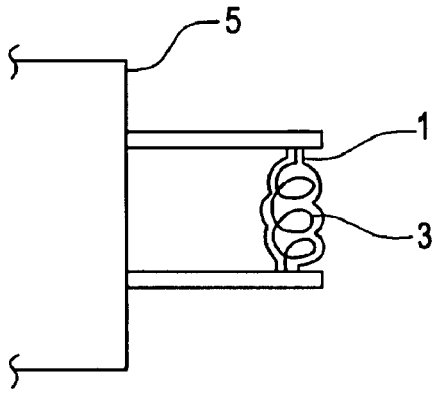
FIG. 1 is a side cross-sectional view of a coil electrode having the electron emissive composition.

Disclosed herein is an electron emissive composition comprising a barium tantalate composition and a ferroelectric oxide composition. These electron emissive compositions combine good electron emissive characteristics with a low evaporation rate and a high sputter resistance. They may advantageously be used in linear fluorescent, circular fluorescent and compact fluorescent lamps.

The barium tantalate composition advantageously has the formula (I)

$$(Ba_{1-x}, Ca_x, Sr_p, D_q)_6(Ta_{1-y}, W_y, E_t, F_u, G_v, Ca_w)_2O_{(11\pm\delta)} \qquad (I)$$

where δ is an amount of about 0 to about 6; and Ba, Ca, Sr, Ta, and W are barium, calcium, strontium, tantalum and tungsten respectively, and D may be either an alkali earth metal ion or an alkaline earth metal ion, while E, F, and G, may be either alkali earth metal ions, alkaline earth metal ions and/or transition metal ions. In the formula (I) above, x is an amount of up to about 0.7, while y is an amount of up to about 1, p and q are amounts of up to about 0.3 and t is an amount of about 0.10 to about 0.50, u is an amount of up to about 0.5, v is an amount of up to about 0.5 and w is an amount of up to about 0.25. In an exemplary embodiment, D is preferably magnesium, E is preferably zirconium (Zr), F is preferably niobium (Nb), and G is preferably titanium (Ti).

Within these ranges it is generally desirable to have x greater than or equal to about 0.25, and preferably greater than or equal to about 0.3. Also desirable within this range is an amount of less than or equal to about 0.4, preferably less than or equal to about 0.38. It is generally desirable to have y less than or equal to about 0.5, preferably less than or equal to about 0.3, and more preferably less than or equal to about 0.1. It is also generally desirable to have y greater than or equal to about 0.01, preferably greater than or equal to about 0.03, and more preferably greater than or equal to about 0.05. It is generally desirable to have p and q less than or equal to about 0.25, preferably less than or equal to about 0.15, and more preferably less than or equal to about 0.1. It is also generally desirable to have p and q greater than or equal to about 0.01, preferably greater than or equal to about 0.05. It is also desirable to have u and v less than or equal to about 0.4, preferably less than or equal to about 0.25. It is also desirable to have u and v greater than or equal to about 0.01, preferably greater than or equal to about 0.02. It is also desirable to have w less than or equal to about 0.15, preferably less than or equal to about 0.10. Similarly it may be desirable to have w greater than or equal to about 0.01, preferably greater than or equal to about 0.05. The preferred barium tantalate compositions are those wherein x in the formula (I) has a value of greater than or equal to about 0.25 and less than or equal to about 0.35, y is an amount of either 0 or 1 and p, q, t, u, v and w are each equal to 0.

The preferred alkali metal ions and alkaline earth metal ions in the barium tantalate composition are sodium, potassium, cesium, rubidium, magnesium, calcium, strontium, or barium. The barium tantalate composition of the formula (I) may be derived from metal compounds such as the respective oxides, carbonates, nitrates, carboxylates, sulfates, chlorides, or the like. In an exemplary embodiment, the barium tantalates are derived from the respective carboxylates, carbonates, oxides and/or nitrates in a solid state synthesis.

The metal compounds such as the oxides, carbonates, nitrates, carboxylates, sulfates, chlorides, or the like, used in the general preparation of the barium tantalate composition may be ground up into the desired particle sizes using a combination of shear and compressive forces in devices such as ball mills, Henschel mixers, Waring blenders, roll mills, and the like. The metal compounds may be ground up for a time period effective to produce particles of about 0.4 to about 8 micrometers. Within this range it is generally desirable to have the particle size greater than or equal to about 0.8 micrometers, preferably greater than or equal to about 1 micrometer, and more preferably greater than or equal to about 1.5 micrometers. Within this range, it is also desirable to have the particle size less than or equal to about 7 micrometers, preferably less than or equal to about 6 micrometers, and more preferably less than or equal to about 5 micrometers.

In an exemplary embodiment, in one manner of proceeding with the preparation of barium tantalate compositions the starting barium, tantalum, calcium, and/or a tungsten powders such as a barium carbonate ($BaCO_3$) powder, a tantalum pentoxide ($Ta_2O_5$) powder, a calcium carbonate ($CaCO_3$) powder and/or a tungsten trioxide ($WO_3$) powder are mixed in a stoichiometric proportion to obtain a first powder that would lead to an electron emissive composition having the desired ratio of efficacy to operating lifetime. Preferably, the tantalum pentoxide powder is milled prior to the mixing step such that its median particle size is 4 microns or less to enhance its reactivity. The first (i.e., mixed) powder is then subjected to a first sintering process to form a sintered body or "cake" which has the requisite barium tantalate composition. Preferably, the first sintering process takes place in a furnace at a temperature of about 1500° C. for about 10 hours. However, other appropriate sintering temperatures and durations may also be used if desired.

The sintered body having the barium tantalate composition is then milled to form a second powder. The second powder is preferably milled in propanol or water as the milling media and subsequently dried. However, other milling media, such as methanol, may also be used. Optionally, zirconium and/or strontium may be added to the first powder or to the second powder as zirconium oxide or strontium carbonate powders to create a desired barium tantalate composition. The second powder having the barium tantalate composition is then mixed with the ferroelectric oxide composition to form an electron emissive precursor composition, which is mixed with a binder and optionally a solvent to form the electron emissive composition.

The second powder having the barium tantalate composition utilizes particles in a size of about 1 to about 10 micrometers. Within this range, it is generally desirable to have the barium tantalate composition particle size greater than or equal to about 1.5 micrometers, preferably greater than or equal to about 2 micrometers, and more preferably greater than or equal to about 3 micrometers. Within this range, it is also desirable to have the barium tantalate composition particle size less than or equal to about 9 micrometers, preferably less than or equal to about 8 micrometers, and more preferably less than or equal to about 6 micrometers. Preferably, the second powder is milled until it has a median particle size of up to about 4 micrometers with a narrow particle distribution.

The barium tantalate composition is added to the electron emissive composition in an amount of about 50 to about 95 weight percent (wt %) based on the total weight of the barium tantalate composition and the ferroelectric oxide composition. Within this range it is generally desirable to have the barium tantalate composition in an amount of greater than or equal to about 55 wt %, preferably greater than or equal to about 60 wt %, and more preferably greater than or equal to about 65 wt % based on the total weight of the barium tantalate composition and the ferroelectric oxide composition. Also desirable is an amount of barium tantalate composition of less than or equal to about 90 wt %, preferably less than or equal to about 88 wt %, and more preferably less than or equal to about 85 wt % based on the total weight of the barium tantalate composition and the ferroelectric oxide composition.

The barium tantalate composition and the ferroelectric oxide composition can both be manufactured by a variety of different methods, all of which generally permit good control over particle size and crystallinity. Suitable examples of such manufacturing processes are the oxalate decomposition method, reactive milling method, sol-gel method, wet chemical precipitation, molten-salt synthesis and mechanochemical synthesis. In one exemplary embodiment, a composite comprising the barium tantalate composition and the ferroelectric oxide composition can also be disposed as a thin or a thick film on a tungsten substrate through a sol-gel process or other physical and/or chemical thin-film deposition methods.

Examples of the ferroelectric oxide compositions that may be used in the electron emissive composition include lithium niobate, lithium tantalate, lead based compounds such as lead magnesium niobate titanate, lead zirconate titanate, lead barium titanate, or the like; perovskites of the barium titanate family, barium strontium titanates, bismuth containing layered structured ferroelectrics of the Aurivillius family such as bismuth titanate, bismuth strontium tantalate, bismuth barium tantalate (SBT), tungsten bronzes, variants of the lead zirconate titanate (PZT family), variations of lead zirconate vanadates, niobates, tantalates, titanates, or the like, or combinations comprising at least one of the foregoing ferroelectric oxide compositions. The preferred ferroelectric oxide compositions are barium titanate, lead zirconate titanate (PZT), strontium barium niobate, lithium niobate, lithium tantalate and strontium bismuth tantalate.

It is generally desirable to use ferroelectric oxide composition particles having a size of about 1 to about 50 micrometers. Within this range, it is generally desirable to have the ferroelectric oxide composition particle size greater than or equal to about 1.5 micrometers, preferably greater than or equal to about 2 micrometers, and more preferably greater than or equal to about 3 micrometers. Within this range, it is also desirable to have the ferroelectric oxide composition particle size less than or equal to about 45 micrometers, preferably less than or equal to about 40 micrometers, and more preferably less than or equal to about 35 micrometers. The preferred median ferroelectric oxide composition particle size is about 4 micrometers.

In one embodiment, metals that are suitable for use as activator additives may be optionally added to the electron emissive material precursor composition to facilitate the formation of the electron emissive composition during sintering. A Group VIIIa transition metal such as nickel may be used as an activator additive. Suitable sintering aids or activator additives include at least one other oxide such as titania ($TiO_2$) or zirconia ($ZrO_2$), which leads to liquid phase sintering of the oxide phase in the composition. Other liquid phase sintering aids for the mixed oxides such as lithium fluoride (LiF), potassium chloride (KCl), lithium chloride (LiCl), lithium sulphate and lithium oxide ($Li_2O$) may also be used. In an exemplary embodiment, $ZrO_2$ may be added in an amount of up to about 2 wt % based on the total weight of the electron emissive composition.

The electron emissive composition may generally be manufactured by various processing methods utilized in the fields of ceramics and metallurgy. As stated above, powders of the barium tantalate compositions with the ferroelectric oxide compositions are generally first mechanically milled if desired, to form an electron emissive precursor composition having particles of a desired size. The particles of the electron emissive precursor composition are then blended with a binder and optionally a solvent to form a wet mixture. The wet mixture may be in the form of a slurry, a suspension, a solution, a paste or the like. Mechanical milling may continue during the formation of the wet mixture. The wet mixture is then coated onto a desired substrate, following which it is allowed to dry to form a green coating. The green coating as defined herein comprises the solvent in an amount of less than or equal to about 10 wt % based on the weight of the wet mixture. It is generally desirable to have the solvent in the green coating at less than or equal to about 8 wt %, preferably less than or equal to about 5 wt % and more preferably less than or equal to about 3 wt %, based on the weight of the wet mixture. The substrate with the green coating is then annealed to facilitate the sintering of the green coating to form the electron emissive composition.

The binders used in the preparation of the wet mixture are polymeric resins, ceramic binders, or combinations comprising polymeric resins and ceramic binders. Polymeric resins used in the preparation of the wet mixture may be thermoplastic resins, thermosetting resins or combinations of thermoplastic resins with thermosetting resins. The thermoplastic resins may be oligomers, polymers, copolymers such as block copolymers, graft copolymers, random copolymers, star block copolymers, dendrimers, polyelectrolytes, ionomers or the like, or combinations comprising at least one of the foregoing thermoplastic resins. Suitable examples of thermoplastic resins are polyacetal, polyacrylic, styrene acrylonitrile, acrylonitrile-butadiene-styrene (ABS), polycarbonates, polystyrenes, polyethylene, polypropylenes, polyethylene terephthalate, polybutylene terephthalate, polyamides, polyamideimides, polyarylates, polyurethanes, polyetherimide, polytetrafluoroethylene, fluorinated ethylene propylene, perfluoroalkoxy polymers, polyethers such as polyethylene glycol, polypropylene glycol, or the like; polychlorotrifluoroethylene, polyvinylidene fluoride, polyvinyl fluoride, polyetherketone, polyether etherketone, polyether ketone ketone, nitrocellulose, cellulose, lignin, or the like, or combinations comprising at least one of the foregoing thermoplastic resins. The preferred thermoplastic resin is nitrocellulose.

It is generally desirable to use thermoplastic resins having a number average molecular weight of about 1000 grams per mole (g/mole) to about 500,000 g/mole. Within this range, it is desirable to use a thermoplastic resin having a number average molecular weight of greater than or equal to about 2,000, preferably greater than or equal to about 3,000 and more preferably greater than or equal to about 4,000 g/mole. Also desirable within this range is a molecular weight of less than or equal to about 200,000, preferably less than or equal to about 100,000 and more preferably less than or equal to about 50,000 g/mole.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polycarbonate/thermoplastic urethane, polycarbonate/polyethylene terephthalate, polycarbonate/polybutylene terephthalate, polyethylene terephthalate/polybutylene terephthalate, styrene-maleicanhydride/acrylonitrile-butadiene-styrene, polyethylene/nylon, polyethylene/polyacetal, or the like, or combinations comprising at least one of the foregoing blends of thermoplastic resins.

Specific non-limiting examples of polymeric thermosetting materials include polyurethanes, epoxy, phenolic, polyesters, polyamides, silicones, or the like, or combinations comprising at least one of the foregoing thermosetting resins.

Ceramic binders may also be used in the preparation of the wet mixture. Suitable examples of ceramic binders are aluminum phosphate ($AlPO_4$), silica ($SiO_2$), and magnesia (MgO). The binders are generally used in an amount of about 5 to about 50 wt % based on the total weight of the wet mixture. Within this range, the binders are generally present in the wet mixture in an amount of greater than or equal to about 8 wt %, preferably greater than or equal to about 10 wt %, and more preferably greater than or equal to about 12 wt % based on the total weight of the wet mixture. Within this range, the binders are generally present in the wet mixture in an amount of less than or equal to about 45, preferably less than or equal to about 40, and more preferably less than or equal to about 35 wt % based on the total weight of the wet mixture.

Solvents may optionally be used in the preparation of the wet mixture. Liquid aprotic polar solvents such as propylene carbonate, ethylene carbonate, butyrolactone, acetonitrile, benzonitrile, nitromethane, nitrobenzene, sulfolane, dimethylformamide, N-methylpyrrolidone, butyl acetate, amyl acetate, methyl propanol or propylene glycol mono-methyl ether acetate with denatured ethanol, or the like, or combinations comprising at least one of the foregoing solvents may generally be used in the preparation of the wet mixture. Polar protic solvents such as water, methanol, acetonitrile, nitromethane, ethanol, propanol, isopropanol, butanol, or the like, or combinations comprising at least one of the foregoing polar protic solvents may also be used in the preparation of the wet mixture. Other non-polar solvents such as benzene, toluene, methylene chloride, carbon tetrachloride, hexane, diethyl ether, tetrahydrofuran, or the like, or combinations comprising at least one of the foregoing solvents may also be used in the preparation of the wet mixture. Co-solvents comprising at least one aprotic polar solvent and at least one non-polar solvent may also be utilized to prepare the wet mixture. Ionic liquids may also be utilized for preparing the wet mixture. The preferred solvent is propylene glycol mono-methyl ether acetate with denatured ethanol. It is generally desirable for the preferred solvent to comprise about 90 to about 95 wt % of propylene glycol mono-methyl ether acetate with about 1 to about 2 wt % of the denatured alcohol.

The solvent is generally used in an amount of about 5 to about 60 wt % based on the total weight of the wet mixture. Within this range, the solvent is generally present in the wet mixture in an amount of greater than or equal to about 8, preferably greater than or equal to about 10, and more preferably greater than or equal to about 12 wt % based on the total weight of the wet mixture. Within this range, the solvent is generally present in the wet mixture in an amount of less than or equal to about 48, preferably less than or equal to about 45, and more preferably less than or equal to about 40 wt % based on the total weight of the wet mixture.

The wet mixture is generally coated onto a desired substrate such as a tungsten wire or sheet and is then subjected to a second sintering process. The substrate may generally be used an electrode for use in a lamp. The coating of the substrate is carried out by processes such as dip coating, spray painting, electrostatic painting, painting with a brush, or the like. The method by which the wet mixture is applied to the substrate may generally determine the robustness of the cathode. In one embodiment, the wet mixture can be coated on the substrate and then resistively heated by passing a nominal current in order to bum the binder and activate the electron emissive material. In another embodiment, the barium tantalate composition, the ferroelectric oxide composition and tungsten powders may be sintered to a high density and used as a composite sintered electrode. Such a composite sintered electrode is expected to offer significant flexibility in the positioning of the cathode within the lamp and allows lamp design flexibility such as fluorescent tubes of narrower diameter.

The coating thickness is generally about 3 micrometers to about 100 micrometers after sintering. Within this range a coating thickness of greater than or equal to about 4 micrometers, preferably greater than or equal to about 5 micrometers, and more preferably greater than or equal to about 8 micrometers is desirable. Also desirable is a coating thickness of less than or equal to about 95 micrometers, preferably less than or equal to about 75 micrometers, and more preferably less than or equal to about 60 micrometers.

The coated substrate is generally subjected to the second sintering process to remove the solvent and binder and to form a coating of the electron emissive composition on the substrate. The second sintering process may be conducted by heating process such as conduction, convection, radiation such as radio frequency radiation or microwave radiation. In another embodiment, the electrode may be resistively heated to sinter the wet mixture to form the electron emissive composition. Combinations of different methods of heating for purposes of sintering, such as, for example, convective heating in combination with resistive heating may also be used if desired. The second sintering process by conduction, convection, radiation, resistive heating or combinations thereof may be carried out at a temperature of about 1000 to about 1700° C. Within this range it is generally desirable to use a temperature of greater than or equal to about 1100° C., preferably greater than or equal to about 1200° C., and more preferably greater than or equal to about 1300° C. Also desirable within this range is a temperature of less than or equal to about 1650° C., preferably less than or equal to about 1625° C., preferably less than or equal to about 1600° C., and more preferably less than or equal to about 1550° C. The preferred temperature for sintering is about 1500° C. The preferred method for sintering is by the use of convective heat.

Alternatively, the sintering may be conducted in a two stage process if desired. In the first stage the binder may be eliminated by heating the green coating to a temperature of about 300° C. to about 400° C. for about 10 to about 60 minutes. In the second stage the material is sintered to a temperature of about 1000° C. to about 1700° C.

The substrate may have any desired shape. It may be either 1-dimensional, 2-dimensional or 3-dimensional or any suitable dimension up to about 3, such as a fractional dimension. Suitable examples of 1 dimensional substrates are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. The preferred substrate is a tungsten filament. In an exemplary embodiment, the substrate is an electrode in a lamp. The electrode may be either an anode, a cathode, or both an anode and a cathode in a lamp.

Figure 2:
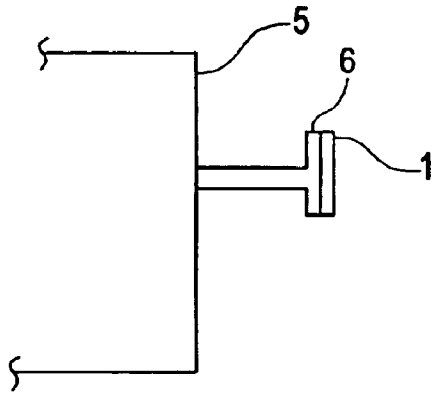
FIG. 2 is a side cross-sectional view of a flat member cathode having the electron emissive composition.
Figure 3:
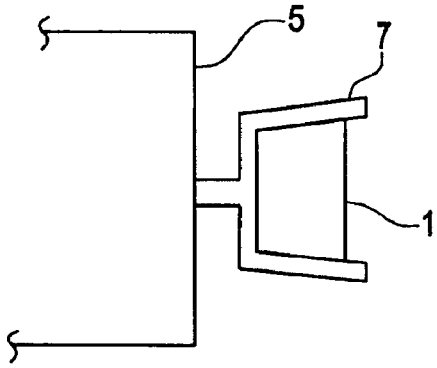
FIG. 3 is a side cross-sectional view of a cup shaped cathode having the electron emissive composition.
Figure 4:
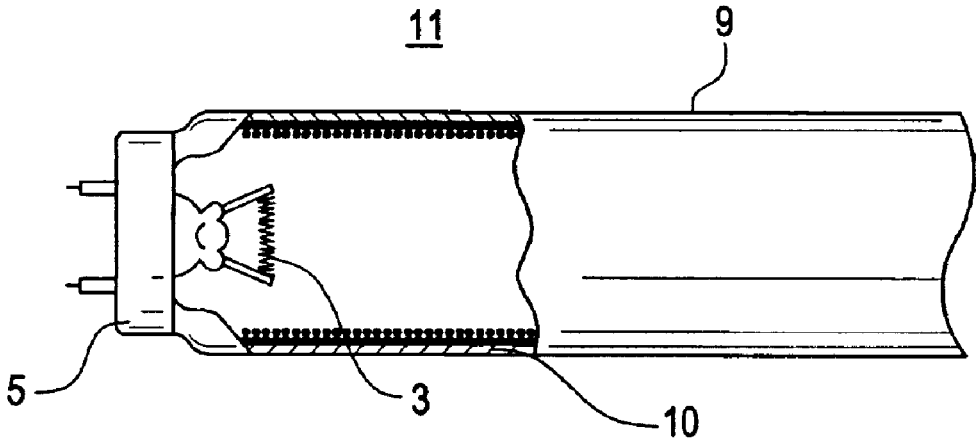
FIG. 4 is a side cross-sectional view of a linear fluorescent lamp having the electron emissive composition.
Figure 5:
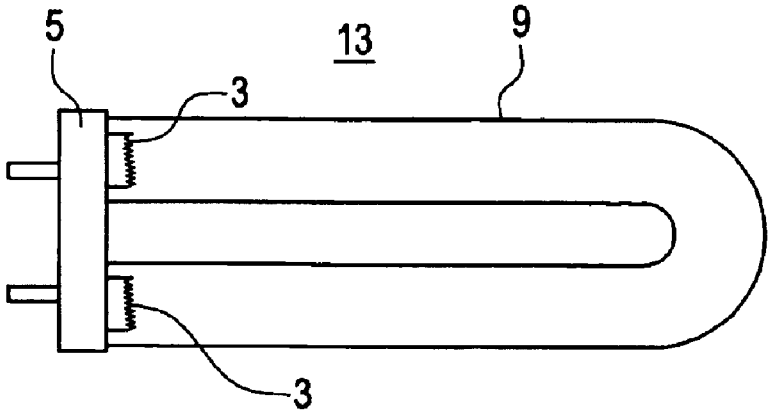
FIG. 5 is a side cross-sectional view of a compact fluorescent lamp having the electron emissive composition.
Figure 6:
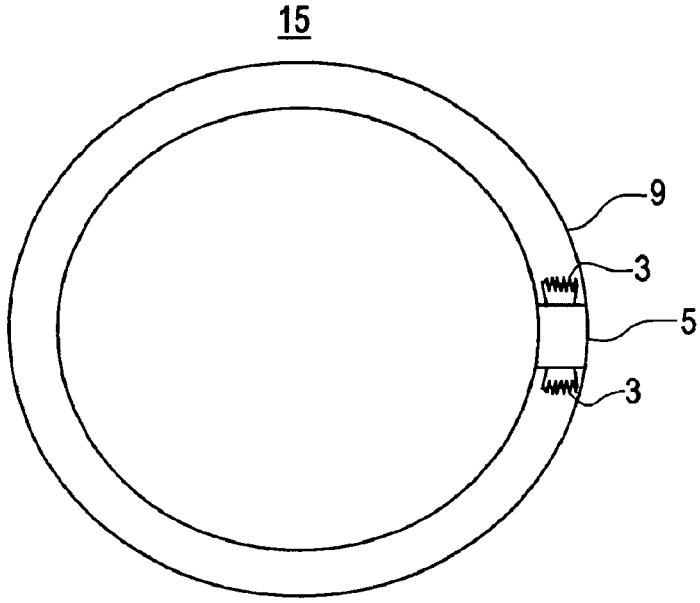
FIG. 6 is a top cross-sectional view of a circular fluorescent lamp having the electron emissive composition.
Figure 7:
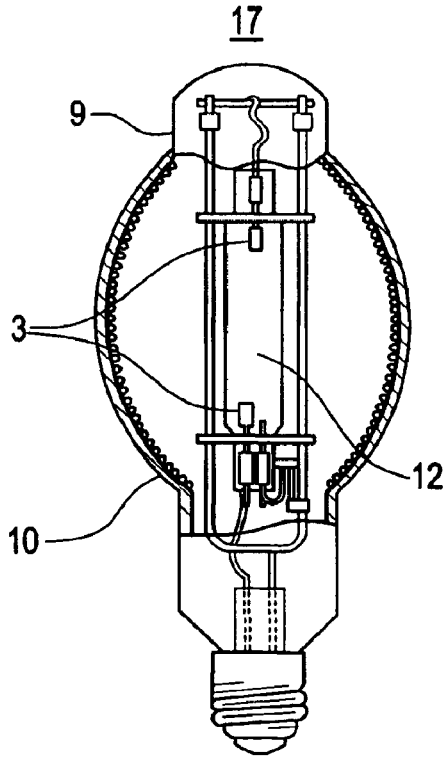
FIG. 7 is a side cross-sectional view of a high pressure fluorescent lamp having the electron emissive composition.

Various embodiments of lamps are depicted in the FIGS. 1–7. These embodiments show how the electron emissive composition may be utilized in various cathode configurations. The applications of the electron emissive compositions are not intended to be limited to the depicted embodiments. The cathode may comprise a wire or a coil 3, such as a tungsten coil illustrated in FIG. 1, connected to a ballast 5. Alternatively, the cathode may comprise a flat member 6 containing the emissive mixture 1 on at least one surface, as illustrated in FIG. 2, or a cup 7 containing the emissive mixture 1 inside the hollow interior space, as illustrated in FIG. 3. The lamp may comprise any lamp, preferably a florescent lamp containing a cathode 3, ballast 5 and a gas containing envelope or cover 9. The interior surface of the envelope may be coated with the electron emissive composition 10. The fluorescent lamp may comprise a linear fluorescent lamp 11 illustrated in FIG. 4, a compact fluorescent lamp 13, illustrated in FIG. 5, or a circular fluorescent lamp 15, illustrated in FIG. 6. Alternatively, the lamp may comprise a high-pressure lamp 17 containing an inner gas envelope 12 inside the outer cover or bulb 9, as illustrated in FIG. 7.

The electron emissive composition may be advantageously used in an electrode of a fluorescent lamp. The electron emissive composition generally has a lower evaporation rate, higher sputter-resistance and easier activation than the currently used tricarbonates. A high loading of the electron emissive material may also help to improve the cathode life. The electron emissive composition can be advantageously handled in air. Since the composite material is stable and does not undergo any chemical conversion (unlike that which takes place in the triple-oxide cathodes), the likelihood of incomplete activation or contamination is significantly reduced.

Figure 8:
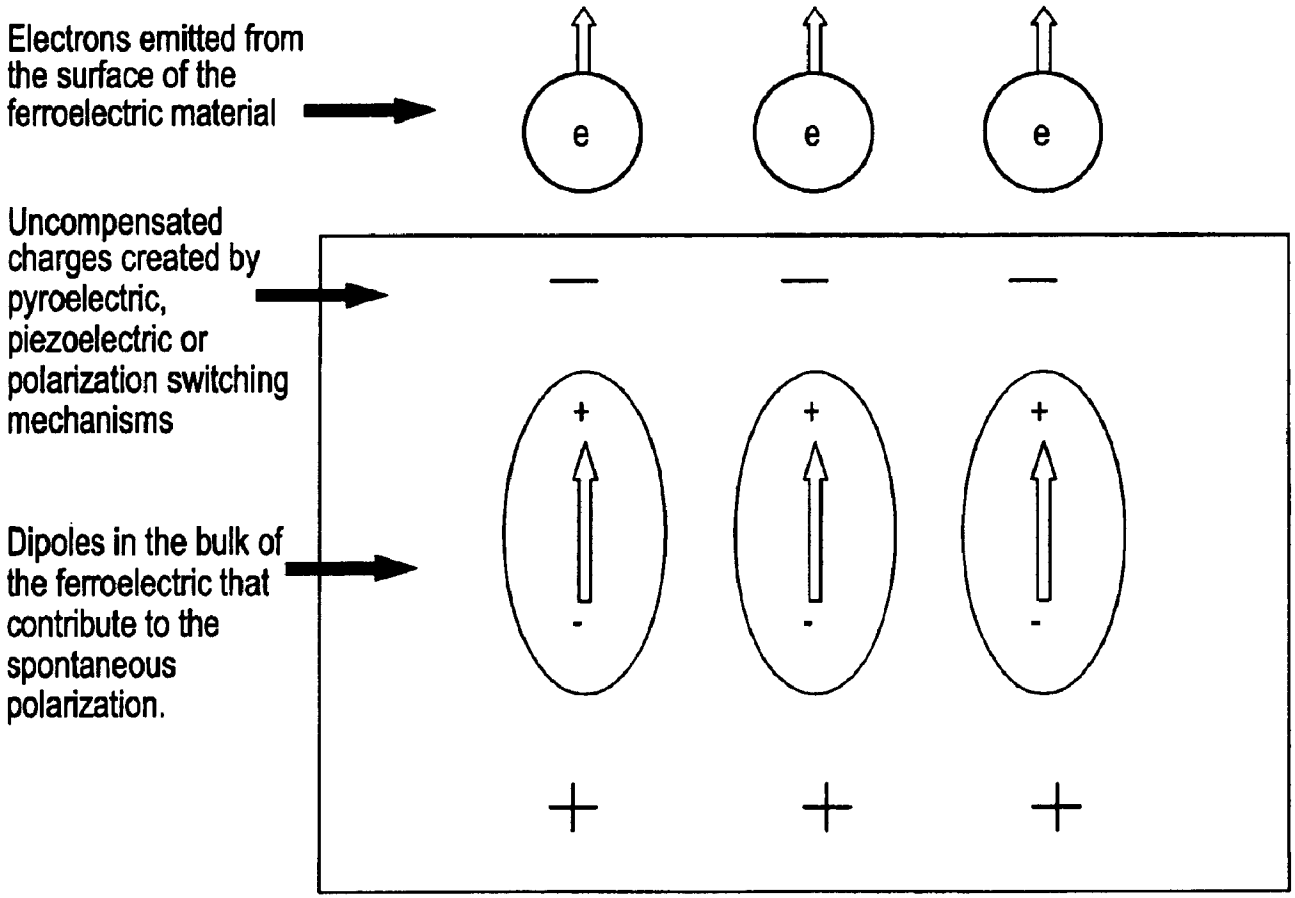
FIG. 8 is a schematic of the physical model of electron emission from a ferroelectric material.

The ferroelectric oxide composition present in the electron emissive composition facilitates strong electron emission due to its ability to generate electrostatic charges on their polar faces as shown in FIG. 8. Ferroelectric oxides are characterized by a high spontaneous polarization and generally contribute significantly to the electron emission through the generation of uncompensated electrostatic charges. These charges are created when their spontaneous polarization is disturbed from its equilibrium state under a pyroelectric effect, piezoelectric effect or polarization switching effect. The heating of the cathode during the initial stage of the lamp operation can disturb the spontaneous polarization of the ferroelectric component and the resulting pyroelectric effect can lead to the generation of uncompensated electrostatic charges. With continued heating, the barium tantalate component of the composite electrodes contributes to the electron emission at higher temperatures. As soon as a sufficient number of electrons have been released on the surface of the cathode, a voltage pulse is applied between the cathode and the anode and the electrons are thus accelerated towards the anode. At this stage the discharge is initiated and sustained. The ferreoelectric component of the composite electrode is thus expected to accelerate the buildup of a critical mass of electrons to initiate a discharge. These composite electrodes will therefore serve as enablers of rapid start and instant start electric discharge lamps.

The electron emissive composition can also have field emission of electrons due to electron tunneling because of the high density of charges present in the ferroelectric composition. Without being limited to theory, the spontaneous polarization of the ferroelectric occurs because of the disruption from its equilibrium state by heating. The uncompensated electrostatic charges generated by the pyroelectric effect leads to electron emission at relatively low temperatures of less than or equal to about 200° C. As soon as a sufficient number of electrons have been released on the surface of the cathode, a voltage pulse is applied between the cathode and the anode and the electrons are thus accelerated towards the anode. At this stage the discharge is initiated and sustained.

The application of the wet mixture to the electrode and its subsequent sintering outside the lamp advantageously prevents the evolution of carbon dioxide during activation of the lamp and therefore reduces the variability in performance of the lamp. Since both the barium tantalate composition and the ferroelectric oxide composition are insensitive to moisture, the resulting electron emissive composition does not produce any dark oxide bands during emission.

The electrodes may also be used in mercury-free discharge lamps such as those based on xenon as well as in flat panel display devices. The use of the composition in high intensity discharge (HID) lamps may require the addition of components such as barium zirconate (which has higher melting point) because of the higher operating temperatures. The high electron density associated with ferroelectric electron emission may even extend the application of these cathodes to X-ray tubes.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electron emissive composition comprising:

a barium tantalate composition in an amount of about 50 to about 95 wt %, and a ferroelectric oxide composition in an amount of about 5 to about 50 wt %, wherein the weight percents are based on the total weight of the barium tantalate composition and the ferroelectric oxide composition.

2. The composition of claim 1, wherein the barium tantalate composition has the formula (I)

$$(Ba_{1-x}, Ca_x, Sr_p, D_q)_6(Ta_{1-y}, W_y, E_t, F_u, G_v, CA_w)_2O_{(11\pm\delta)} \quad (I)$$

wherein δ is an amount of 0 to about 6; and wherein D is an alkali earth metal ions or an alkaline earth metal ions; E, F, and G are alkali earth metal ions, alkaline earth metal ions and/or transition metal ions; x is an amount of up to about 0.7; y is an amount of up to about 1; p and q are amounts of up to about 0.3; t is an amount of about 0.10 to about 0.50; u is an amount of up to about 0.5; v is an amount of up to about 0.5 and w is an amount of up to about 0.25.

3. The composition of claim 2, wherein D is magnesium, E is zirconium, F is niobium, and G is titanium.

4. The composition of claim 2, wherein x is in an amount of about 0.25 to about 0.35, y is about 1, and p, q, t, u, v and w are each equal to 0.

5. The composition of claim 2, wherein x is in an amount of about 0.25 to about 0.35, and y, p, q, t, u, v and w are each equal to 0.

6. The composition of claim 1, wherein the barium tantalate composition particles have sizes of about 1 to about 10 micrometers.

7. The composition of claim 1, wherein the ferroelectric oxide composition comprises lead.

8. The composition of claim 7, wherein the ferroelectric composition comprises lead magnesium niobate titanate, lead zirconate titanate, lead barium titanate, lead zirconate vanadates, lead zirconate niobate, lead zirconate tantalate, lead zirconate titanate, or a combination comprising at least one of the lead based compounds.

9. The composition of claim 1, wherein the ferroelectric oxide composition is lithium niobate, lithium tanatalate, a perovskite of the barium titanate family or a bismuth containing layered structured ferroelectric of the Aurivillius family.

10. The composition of claim 9, wherein the bismuth containing layered structured ferroelectric of the Aurivillius family is bismuth titanate, bismuth strontium tantalate, bismuth barium tantalate, or a combination comprising at least one of the foregoing ferroelectric of the Aurivillius family.

11. The composition of claim 1, wherein the ferroelectric oxide composition particles have sizes of about 1 to about 50 micrometers.

12. The composition of claim 1, further comprising a binder.

13. The composition of claim 12, wherein the binder is nitrocellulose.

14. The composition of claim 1, further comprising a solvent.

15. The composition of claim 13, wherein solvent is propylene glycol mono-methyl ether acetate comprising about 1 to about 2 wt % denatured alcohol based on the total weight of the propylene glycol mono-methyl ether acetate and denatured alcohol.

16. An electrode manufactured from the composition of claim 1.

17. An electrode comprising a substrate; and an electron emissive composition disposed upon the substrate, wherein the electron emissive composition comprises a barium tantalate composition in an amount of about 50 to about 95 wt %; and a ferroelectric oxide composition in an amount of about 5 to about 50 wt %, wherein the weight percents are based on the total weight of the barium tantalate composition and the ferroelectric oxide composition.

18. The electrode of claim 17, wherein the substrate is tungsten.

19. The electrode of claim 17, wherein the electrode is used in a linear fluorescent lamp, compact fluorescent lamp, or a circular fluorescent lamp.

* * * * *